US006036870A

United States Patent [19]

Briant et al.

[11] Patent Number: 6,036,870

[45] Date of Patent: Mar. 14, 2000

[54] METHOD OF WELLBORE FLUID RECOVERY USING CENTRIFUGAL FORCE

[75] Inventors: J. C. Briant; Michael Reid, both of Lafayette, La.

[73] Assignee: Tuboscope Vetco International, Inc., Houston, Tex.

[21] Appl. No.: 09/024,471

[22] Filed: Feb. 17, 1998

[51] Int. Cl.[7] ..... B01D 21/26; E21B 21/06

[52] U.S. Cl. ..... 210/781; 210/787; 210/806; 209/729; 175/66; 166/265; 134/10

[58] Field of Search ..... 210/774, 781, 210/787, 806, 512.2; 134/10; 175/66; 166/265; 209/1, 729

[56] References Cited

U.S. PATENT DOCUMENTS

| | | | |
|---|---|---|---|
| D. 296,027 | 5/1988 | Dietzen | D34/39 |
| D. 337,809 | 7/1993 | Dietzen | D23/202 |
| 2,870,990 | 1/1959 | Bergey | 175/66 |
| 3,003,347 | 10/1961 | Morris et al. . | |
| 3,192,155 | 6/1965 | Bready et al. | 210/705 |
| 3,378,018 | 4/1968 | Lawter . | |
| 3,502,215 | 3/1970 | Cahan . | |
| 3,510,890 | 5/1970 | Estabrook . | |
| 3,515,507 | 6/1970 | Estabrook . | |
| 3,737,037 | 6/1973 | Bone, III | 175/66 |
| 3,841,116 | 10/1974 | Klein et al. . | |
| 4,108,768 | 8/1978 | Sebelik et al. . | |
| 4,211,650 | 7/1980 | Thomas . | |
| 4,211,651 | 7/1980 | Thomas . | |
| 4,211,652 | 7/1980 | Thomas . | |
| 4,652,368 | 3/1987 | Ennis et al. | 210/97 |
| 5,076,937 | 12/1991 | Montgomery | 210/705 |
| 5,080,721 | 1/1992 | Flanigan et al. | 210/781 |
| 5,124,049 | 6/1992 | Maness | 210/715 |
| 5,207,922 | 5/1993 | McFarlan et al. | 210/708 |
| 5,213,625 | 5/1993 | Van Slyke | 134/10 |
| 5,402,857 | 4/1995 | Dietzen | 175/66 |
| 5,439,489 | 8/1995 | Scalliet et al. | 44/281 |
| 5,443,717 | 8/1995 | Scalliet et al. | 208/131 |
| 5,564,509 | 10/1996 | Dietzen | 175/66 |
| 5,641,071 | 6/1997 | Read et al. | 209/319 |
| 5,643,169 | 7/1997 | Leung et al. | 494/53 |

OTHER PUBLICATIONS

"Sweco Oilfield Services, A Division of Environmental Procedures, Inc.," Environmental Procedures, Inc., 1995.

"Separation Through Technology—Composite Catalog," Brandt EPI, Feb. 1996.

"SC 35 HS High Speed Decanting Centrifuge," Sweco Oilfield Services, 1995.

"New Technology In Automated Wastewater Systems," Environmenta Procedures, Inc., 1996.

"Fluid Processing Equipment For the Drilling & Environmental Industries," Tri–Flo Int'l Inc., 1996.

"Pressure Control Solids Control Rig Instrumental," Swaco Geolograph, Dec. 1993.

*Primary Examiner*—David A. Reifsnyder

*Attorney, Agent, or Firm*—Finnegan, Henderson, Farabow, Garrett & Dunner L.L.P.

[57] ABSTRACT

A method for recovering a component from a wellbore fluid mixture has been invented that includes feeding a wellbore fluid mixture to a decanting centrifuge, the wellbore fluid containing at least one liquid component and undesirable solids; separating undesirable solids from the wellbore fluid mixture with the decanting centrifuge, producing an intermediate fluid containing the at least one liquid component and a reduced amount of the undesirable solids; and feeding the intermediate fluid to a secondary centrifuge, producing a final fluid containing the at least one liquid component and a further reduced amount of the undesirable solids. In certain aspects at least some of the undesirable solids are barite pieces, which in one aspect have a largest dimension of no more than 192 microns, and in one aspect wherein at least 50% or 99% of the barite pieces by weight are removed. Such a method is useful, in certain aspects, to separate undesirable solids have a largest dimension of at least 75 microns. In one aspect the method is useful to separate brine from a wellbore fluid.

11 Claims, 1 Drawing Sheet

METHOD OF WELLBORE FLUID RECOVERY USING CENTRIFUGAL FORCE

BACKGROUND OF THE INVENTION

1. Field of the Invention

This invention is directed to systems and methods for the recovery of fluid components from fluids used in wellbore operations. In certain particular embodiments this invention is directed to systems and methods for recovering base fluids from wellbore drilling and completion fluids, such base fluids including water and soluble additives, diesel, synthetic oils, mineral oils, brine, metal salt and other additives.

2. Description of Related Art

Fluids used in wellbore operations can be complex mixtures with various components present in precise amounts. In conventional rotary drilling, a borehole is advanced down from the surface of the earth (or bottom of the sea) by rotating a drill string having a drill bit at its lower end. Sections of hollow drill pipe are added to the top of the drill string, one at a time, as the borehole is advanced in increments. In its path downward, the drill bit may pass through a number of strata before the well reaches the desired depth. Each of these subsurface strata has associated with it physical parameters, e.g., fluid content, hardness, porosity, pressure, inclination, etc., which make the drilling process a constant challenge. Drilling through a stratum produces significant amounts of rubble and frictional heat; each of which must be removed if efficient drilling is to be maintained in typical rotary drilling operations, heat and rock chips are removed by the use of a fluid known as drilling fluid or drilling mud. Drilling mud is circulated down through the drill string, out through orifices in the drill bit where the mud picks up rock chips and heat, and returns up the annular space between the drill string and the borehole wall to the surface. The mud is, typically, sieved on the surface, reconstituted, and pumped back down the drill string.

Drilling mud may be as simple in composition as clear water, but more likely it is a complicated mixture of various components, e.g., but not limited to, clays, thickeners, and weighting agents. The characteristics of the drilled geologic strata and, to some extent, the nature of the drilling apparatus determine the physical parameters of the drilling fluid. For instance, the drilling mud must be capable of carrying the rock chips to the surface from the drilling site. Shale-like rocks often produce chips which are flat. Sandstones are not quite so likely to produce a flat chip. The drilling fluid must be capable of removing either type of chip. Conversely, the mud must have a viscosity which will permit it to be circulated at high rates without excessive mud pump pressures.

In the instance where a high pressure layer, e.g., a gas formation, is penetrated, the density of the drilling mud must be increased to the point such that the hydrostatic or hydraulic head of the mud is greater than the downhole (or "formation") pressure. This prevents gas leakage out into the annular space surrounding the drill pipe and lowers the chances for the phenomenon known as "blowout" in which the drilling mud is blown from the well by the formation gas. Finely ground barite (barium sulfate) is the additive most widely used to increase the specific gravity of drilling mud; although, in special circumstances, iron ore, lead sulfide ferrous oxide, or titanium dioxide may also be added.

In strata which are very porous or are naturally fractured and which have formation pressures comparatively lower than the local pressure of the drilling mud, another problem occurs. The drilling fluid, because of its higher hydrostatic head, will migrate out into the porous layer rather than completing its circuit to the surface. This phenomenon is known as "lost circulation." A common solution to this problem is to add a lost circulation additive such as gilsonite.

Fluid loss control additives may be included such as one containing either bentonite clay (which in turn contains sodium montmorillonite) or attapulgite, commonly known as salt gel. If these clays are added to the drilling mud in a proper manner, they will circulate down through the drill string, out the drill bit nozzles, and to the site on the borehole wall where liquid from the mud is migrating into the porous formation. Once there, the clays, which are microscopically plate-like in form, form a filter cake on the borehole wall. Polymeric fluid control agents are also well known. As long as the filter cake is intact, very liquid will be lost into the formation.

The properties required in drilling mud constantly vary as the borehole progresses downward into the earth. In addition to the various materials already noted, such substances as tannin-containing compounds (to decrease the mud's viscosity), walnut shells (to increase the lubricity of the mud between the drillstring and the borehole wall), colloidal dispersions, e.g., starch, gums, carboxy-methyl-cellulose (to decrease the tendency of the mud to form excessively thick filter cakes on the wall of the borehole), and caustic soda (to adjust the pH of the mud) are added as the need arises.

The fluid used as drilling mud is a complicated mixture tailored to do a number of highly specific jobs.

Once the hole is drilled to the desired depth, the well must be prepared for production. The drill string is removed from the borehole and the process of casing and cementing begins.

A well that is several thousand feet long may pass through several different hydrocarbon producing formations as well as a number of water producing formations. The borehole may penetrate sandy or other unstable strata. It is important that in the completion of a well each producing formation be isolated from each of the others as well as from fresh water formations and the surface. Proper completion of the well should stabilize the borehole for a long time. Zonal isolation and borehole stabilization are also necessary in other types of wells, e.g., storage wells, injection wells, geothermal wells, and water wells. This is typically done, no matter what the type of well, by installing metallic tubulars in the wellbore. These tubulars known as "casing," are often joined by threaded connections and cemented in place.

The process for cementing the casing in the wellbore is known as "primary cementing." In an oil or gas well, installation of casing begins after the drill string is "tripped" out of the well. The wellbore will still be filled with drilling mud. Assembly of the casing is begun by inserting a single piece of casing into the borehole until only a few feet remain above the surface. Another piece of casing is screwed onto the piece projecting from the hole and the resulting assembly is lowered into the hole until only a few feet remain above the surface. The process is repeated until the well is sufficiently filled with casing.

A movable plug, often having compliant wipers on its exterior, is then inserted into the top of the casing and a cement slurry is pumped into the casing behind the plug. The starting point for a number of well cements used in that slurry is Portland cement, the very same composition first patented by Joseph Aspdin, a builder from Leeds, England, in 1824. Portland cement contains Tricalcium silicate, Dicalcium silicate, Tricalcium aluminate, Tetracalcium aluminoferrite and other oxides. API Class A, B, C, G and H cements are all examples of Portland cements used in well applications. Neat cement slurries may be used in certain circumstances; however, if special physical parameters are required, a number of additions may be included in the slurry. As more cement is pumped in, the drilling fluid is displaced up the annular space between the casing and the borehole wall and out at the surface. When the movable plug reaches a point at or near the bottom of the casing, it is then ruptured and cement pumped through the plug and into the space between the casing and the borehole wall. Additional cement slurry is pumped into the casing with the intent that it displace the drilling mud in the annular space. When the cement cures, each producing formation should be permanently isolated thereby preventing fluid communication from one formation to another. The cemented casing may then be selectively perforated to produce fluids from particular strata.

However, the displacement of mud by the cement slurry from the annular space is rarely complete. This is true for a number of reasons. The first may be intuitively apparent. The borehole wall is not smooth but instead has many crevices and notches. Drilling mud will remain in those indentations as the cement slurry passes by. Furthermore, as noted above, clays may be added to the drilling mud to form filter cakes on porous formations. The fact that a cement slurry flows by the filter cake does not assure that the filter cake will be displaced by the slurry. The differential pressure existing between the borehole fluid and the formation will tend to keep the cake in place. Finally, because of the compositions of both the drilling mud and the cement slurry, the existence of non-Newtonian flow is to be expected. The drilling mud may additionally possess thixotropic properties, i.e., its gel strength increases when allowed to stand quietly and the gel strength then decreases when agitated.

The use of drilling fluids has improved drilling rates and reduced the amount of down-hole problems associated with drilling and completion fluids. The controlled removal of undesirable solids during the drilling and completion operations maintains fluid parameters in specification.

The prior art discloses a wide variety of systems and methods for cleaning wellbore fluids, removing undesirable components, separating fluid components, and for maintaining a desired mixture of fluid components.

U.S. Pat. No. 5,190,645 discloses a drilling mud system in which drilling mud is pumped by a pump into drill pipe and out through nozzles in a bit. The mud cools and cleans the cutters of the bit and then passes up through the well annulus flushing cuttings out with it. After the mud is removed from the well annulus, it is treated before being pumped back into the pipe. First, the mud enters a shale shaker where relatively large cuttings are removed. The mud then enters a degasser where gas can be removed if necessary. The degasser may be automatically turned on and off, as needed, in response to an electric or other suitable signal produced by a computer and communicated to the degasser. The computer produces the signal as a function of data from a sensor assembly associated with the shale shaker. The data from sensor assembly is communicated to the computer. The mud then passes to a desander (or a desilter), for removal or smaller solids picked up in the well. The mud next passes to a treating station where, if necessary, conditioning media, such as barite, may be added. Suitable flow controls control flow of media. Valves may be automatically operated by an electric or other suitable signal produced by the computer as a function of the data from sensor assembly, such signal being communicated to a valve. The mud is directed to a tank from which a pump takes suction, to be re-cycled through the well. The system may include additional treatment stations and centrifuges.

There has long been a problem with the handling and processing of hazardous waste material related to the operation of certain wellbore fluid systems and methods. There has long been a need for an efficient and effective wellbore fluid processing system and method. There has long been a need for a system and method for efficiently and effectively reclaiming fluid components and other components from a wellbore fluid mixture.

SUMMARY OF THE PRESENT INVENTION

In certain embodiments, the present invention teaches a system for recovering components from a wellbore fluid, the system including apparatus such as a centrifuge, a decanting centrifuge, a heater, and a heat exchanger for removing material, e.g. shale, sand, limestone and other solids from the fluid. A decanting centrifuge may be used for removing both high and low gravity solids from the fluid. A liquid/liquid separator may be used for removing liquids, e.g. but not limited to brine and water, from the fluid.

In one particular aspect the present invention discloses such a system for the removal of re-usable barite from drilling fluid. This system, in one aspect, also includes: a barite treatment system; a barite recovery centrifuge; and a barite recovery tank.

In another particular aspect, the present invention discloses a system for recovering components from a wellbore fluid, as described above, for recovering brine from drilling fluid. In one aspect, this system includes: filtration apparatus and a brine recovery tank.

It is, therefore, an object of at least certain preferred embodiments of the present invention to provide:

New, useful, unique, efficient, nonobvious systems and methods for recovering components (solid and/or liquid) from wellbore fluids; for recovering barite from wellbore fluids; and for recovering brine from wellbore fluids;

Such systems that effectively remove fine particles from wellbore fluids; and

Such systems and methods that produce re-usable, re-cyclable material.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
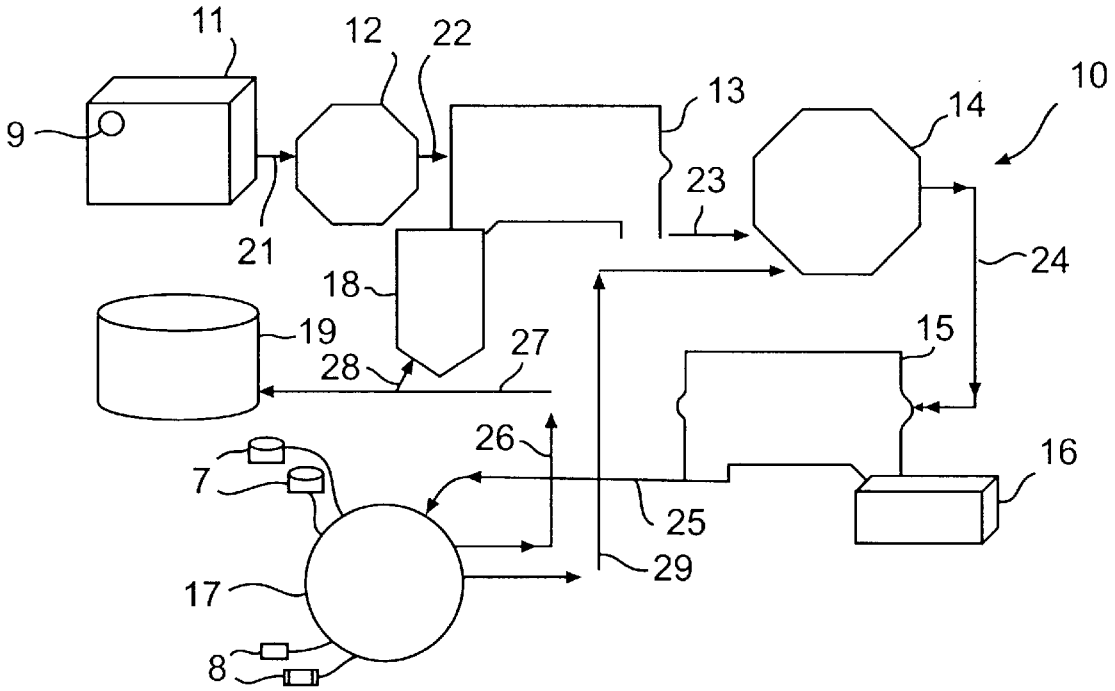
FIG. 1 is a schematic view of a system according to the present invention.

As shown in FIG. 1, a system 10 according to the present invention has a mud tank 11 that contains drilling mud which is a mixture of at least liquid drilling fluid and barite material. Any known mixers or mixing system 9 may be used in the tank 11 to maintain the homogeneity of the tank's contents. The barite is present as a liquid slurry (e.g. pieces with a largest dimension of 192 microns or less). This mud is fed (e.g. pumped by a pump) from the tank 11 via a flow line 21 to a barite recovery enhancement treatment apparatus 12. Within the apparatus 12, fluid may be heated (e.g. but not limited to, from ambient temperature to 300° F. or more); air bubbles may be introduced to lower fluid viscosity; recovered fluid may be added to reduce viscosity; fluid may be sheared; and/or treated ultrasonically.

The treated fluid is then fed via a flow line 22 to a barite recovery centrifuge 13 (e.g. like a commercially available Mode 414 from Alfa Laval Company). In one aspect, a dual back-drive centrifuge (such as the Model 414) is used. In the centrifuge 13 barite solids are separated from the fluid and flow into a barite recovery tank 18. In certain aspects about 50% up to 99% by weight of the barite is taken from the fluid.

The fluid then flows from the centrifuge 13 via a flow line 23 to solids removal treatment apparatus 14 (such as a Model S12-60-50 commercially available from Gordon Piaff Company). In the apparatus 14 the fluid may be heated (e.g., but not limited to, up to 300° F. or more); and additional fluid (up to about 50%) (e.g., but not limited to, fluid recovered by the system 10) may be added to reduce viscosity. Other treatments possible in apparatus 14 include shearing, heating, mixing, heat exchange and/or ultrasonic treatment.

The fluid is then fed via a line 24 to a decanting centrifuge 15 such as Model 3400 commercially available from Sharples Company, which in one aspect, is a dual back-drive centrifuge. The centrifuge 15 removes undesirable solids such as silt, sand, barite, and formation fines from the fluid entering the centrifuge. In one aspect, these solids flow to a collection container such as a solids waste box 16. Alternatively, they can be hauled off for disposal.

The decanted fluid then flows from the centrifuge 15 to a liquid/liquid separator 17 for separating very small solid particles from the fluid and/or for separating oil/brine liquid from undesirable liquid. A commercially available "ultra high G" "nozzle jet" centrifuge such as Model 24 HB commercially available from Dorr Oliver Company may be used for the separator 17. In one aspect the nozzle jet centrifuge separates undesirable solid particles (e.g. particles with a largest dimension of about 75 microns) from the fluid. Typical pumps 8 and tanks 7 may be used with the separator 17, e.g. such as those used with an ultra high G nozzle jet centrifuge. A stream with undesirable solids flows in line 29 to the apparatus 14 or it could, alternatively, be fed directly to the centrifuge 15.

Fluid processed by the separator 17 flows in line 27 to a recovery tank 19. Typically this purified fluid is oil and/or this fluid includes additives, brines, and minimal solids. Preferably, this fluid is in condition for re-use in wellbore operations; or, with additional treatment to produce a usable drilling fluid in condition for re-use.

In one aspect, the system 10 is used to recover barite from drilling fluid. The fluid removed from the tank 11 is tested e.g. retort, particle size analysis, and density testing, to determine recovery ratio and equipment settings. Such testing indicated treatment(s) to be applied in the treatment apparatus 12. Fluid flowing in the line 23 from the centrifuge 13 is also similarly tested. Such testing can indicate the nature of and settings for the apparatus 14, e.g. temperature, solids load, and optimum operating parameters for it, such as viscosity and ratio settings. The fluid flowing from the centrifuge 15 enters the separator 17. With appropriate nozzle and disk selection for an ultra high G nozzle jet centrifuge as the separator 17, fusion of fine clays and other submicron solid particles in the fluid is enhanced, producing manageable larger particles. Underflow fluid containing e.g. increased size or concentration solids is fed back to the apparatus 14 for re-treatment. Overflow fluid containing less solids is fed to the tank 19. A portion of the overflow fluid (e.g. 1% to 99%) may be fed in the line 28 to the tank 18 (e.g. to blend a heavy weight fluid for re-use in lighter weight system, e.g. 19.5 parts per gallon blended with 6.7 parts per gallon).

Figure 2:
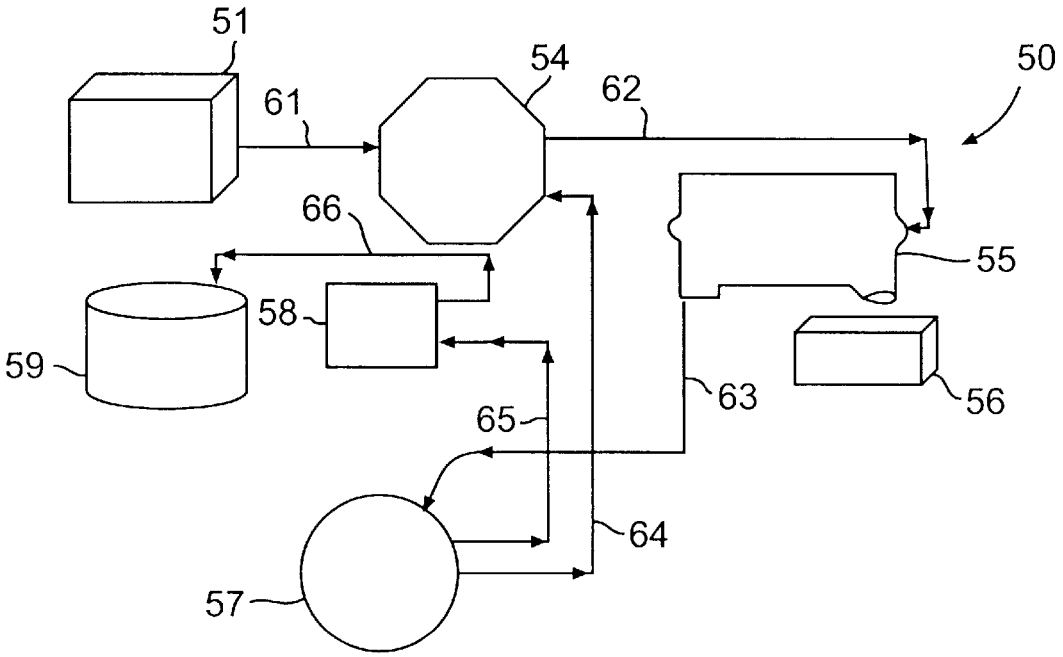
FIG. 2 is a schematic view of a system according to the present invention.

A system 50 as shown in FIG. 2 is directed to removing brine from a drilling fluid. Drilling fluid containing brine is maintained homogeneously in a tank 51 (which may have a system 9 as in FIG. 1). The solids removal treatment apparatus 54 is like the apparatus 14 of FIG. 1. The centrifuge 55 is like the centrifuge 15 of FIG. 1. The separator 57 is like the separator 17 of FIG. 1, but may be modified to deal with heavy liquids, e.g. using a booster pump, impeller, and resized nozzle.

Purified fluid from the separator 57 is fed via a flow line 65 to filtration apparatus 58 in which very fine particles (e.g. with a largest dimension of 10 microns or less) are removed. In one aspect the filtration apparatus 58 is a filter press Model JWI 1200N-25-110-108-SYHS commercially available from JWI Company. In one aspect Perlite or diatomaceous earth are fed to the system.

Recovered fluid flows from the filtration apparatus 58 to a tank 59. Preferably, such fluid is ready for re-use. Alternatively, such fluid may be treated further, e.g. thermally or by surface filtration, reverse osmosis and/or chemical breakdown. Such fluid is then suitable for re-cycling and re-use.

Concentrated solids and/or polymers flow in line 64 from the centrifuge 57 to the apparatus 54, or alternatively, centrifuge 55.

The present invention, therefore, in certain aspects, discloses a method for recovering a component from a wellbore fluid mixture that includes feeding a wellbore fluid mixture to a decanting centrifuge, the wellbore fluid containing at least one liquid component and undesirable solids, separating undesirable solids from the wellbore fluid mixture with the decanting centrifuge, producing an intermediate fluid containing the at least one liquid component and a reduced amount of the undesirable solids, and feeding the intermediate fluid to a secondary centrifuge, producing a final fluid containing the at least one liquid component and a further reduced amount of the undesirable solids; such a method wherein at least some of the undesirable solids are barite pieces, wherein the barite pieces have a largest dimension of no more than 192 microns, wherein at least 50% of the barite pieces by weight are removed, and/or wherein at least 99% of the barite pieces by weight are removed; any such method wherein separated undesirable solids have a largest dimension of at least 75 microns; any such method wherein the wellbore fluid is drilling mud; any such method wherein the at least one liquid component of the wellbore fluid includes brine; any such method further comprising filtering the final fluid to purify brine therein; any such method including removing particles with a largest dimension of no more than 10 microns from the final fluid; any such method wherein the final fluid is reusable as a wellbore fluid.

The present invention, in certain aspects, discloses a method for recovering a component from a wellbore fluid mixture, the method including feeding a wellbore fluid mixture to a decanting centrifuge, the wellbore fluid containing at least one liquid component, barite pieces, and undesirable solids, separating undesirable solids from the wellbore fluid mixture with the decanting centrifuge, producing an intermediate fluid containing the at least one liquid component and a reduced amount of the undesirable solids, feeding the intermediate fluid to a secondary centrifuge, producing a final fluid containing the at least one liquid component and a further reduced amount of the undesirable solids, wherein the barite pieces have a largest dimension of no more than 192 microns, and at least 99% of the barite pieces by weight are removed from the wellbore fluid The present invention, in certain aspects, discloses a method for recovering a component from a wellbore fluid mixture, the method including mixing the wellbore fluid in a tank to maintain homogeneity, feeding a wellbore fluid mixture to a decanting centrifuge, the wellbore fluid containing at least one liquid component and undesirable solids, separating undesirable solids from the wellbore fluid mixture with the decanting centrifuge, producing an intermediate fluid containing the at least one liquid component and a reduced amount of the undesirable solids, feeding the intermediate fluid to a secondary centrifuge, producing a final fluid containing the at least one liquid component and a further reduced amount of the undesirable solids, the at least one liquid component of the wellbore fluid includes brine, and filtering the final fluid to purify the brine, the final fluid then reusable as a wellbore fluid.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A method for recovering a component from a wellbore fluid mixture, comprising:

mixing the wellbore fluid in a tank to maintain homogeneity, lowering viscosity of the wellbore fluid mixture, feeding the wellbore fluid mixture to a decanting centrifuge, the wellbore fluid mixture containing at least one liquid component and undesirable solids, separating undesirable solids from the wellbore fluid mixture with the decanting centrifuge to produce an intermediate fluid containing the at least one liquid component and a reduced amount of the undesirable solids, feeding the intermediate fluid to a secondary centrifuge to produce a final fluid containing the at least one liquid component and a further reduced amount of the undesirable solids, and filtering the final fluid, whereby the final fluid is then reusable as wellbore fluid.

2. The method of claim 1 wherein at least some of the undesirable solids are barite pieces.

3. The method of claim 2 wherein the barite pieces have a largest dimension of no more than 192 microns.

4. The method of claim 2 wherein at least 50% of the barite pieces by weight are removed.

5. The method of claim 2 wherein at least 99% of the barite pieces by weight are removed.

6. The method of claim 1 wherein separated undesirable solids have a largest dimension of at least 75 microns.

7. The method of claim 1 wherein the wellbore fluid is drilling mud.

8. The method of claim 1 wherein the at least one liquid component of the wellbore fluid includes brine.

9. The method of claim 8 further comprising filtering the final fluid to purify the brine.

10. The method of claim 9 further comprising removing particles with a largest dimension of no more than 10 microns from the final fluid.

11. The method of claim 1, wherein said viscosity of said intermediate fluid is lowered prior to feeding said intermediate fluid to said secondary centrifuge.

* * * * *